US006282985B1

(12) United States Patent
Tseng

(10) Patent No.: US 6,282,985 B1
(45) Date of Patent: Sep. 4, 2001

(54) MULTI-FUNCTION BOTTLE OPENER

(76) Inventor: Justin Wen-Tien Tseng, 6D Hilton Towers, 96 Granville Road, T.S.T. East, Kln. (HK)

( * ) Notice: Subject to any disclaimer, the term of this patent is extended or adjusted under 35 U.S.C. 154(b) by 0 days.

(21) Appl. No.: 09/541,075

(22) Filed: Mar. 31, 2000

(51) Int. Cl.[7] ..... B67B 7/18
(52) U.S. Cl. ..... 81/3.29; 81/3.48
(58) Field of Search ..... 81/3.09, 3.29, 81/3.48

(56) References Cited

U.S. PATENT DOCUMENTS

| | | | | |
|---|---|---|---|---|
| 1,421,169 | * | 6/1922 | Chmura | 81/3.29 |
| 4,979,407 | * | 12/1990 | Hernandez et al. | 81/3.09 |
| 5,086,675 | * | 2/1992 | Leung et al. | 81/3.29 |
| 5,887,305 | * | 3/1999 | Cellini | 81/3.09 X |

* cited by examiner

*Primary Examiner*—James G. Smith
(74) *Attorney, Agent, or Firm*—Rosenberg, Klein & Lee

(57) ABSTRACT

An improved multi-function bottle opener includes a hollow body (10), a piston (20), a helical coil (30), and a collar (40).

The hollow body has a bore (12), a counter bore (14), a shoulder (18) formed between the bore (12) and the counter bore (14), and two opposed trackways (16) defined in an inner wall defining the bore (12). Each trackway (16) is formed as a loop and includes a longitudinal portion (166) and a helical portion (168). The piston (20) is slidably received in the bore (12), and has two opposed lugs (22) which are slidably received in a respective one of the trackways (16). The helical coil (30) is secured to a bottom face of the piston (20). The collar (40) is slidably received in the counterbore (14), and is reciprocatingly urged between the shoulder (18) and an inner flange (142) formed at a bottom of the counterbore (14). As the helical coil (30) turns, it and the piston (20) are drawn down the longitudinal portion (166) to a bottom limit thereof, whereafter the lugs (22) enter the helical portions (168) and the piston (20) and helical coils (30) accordingly return to a top limit of the longitudinal portion (166), whereby the cork is removed from the bottle despite the bottle opener remaining mated with the bottle, and the body (10) having been continually rotated in a single direction.

9 Claims, 11 Drawing Sheets

MULTI-FUNCTION BOTTLE OPENER

BACKGROUND OF THE INVENTION

1. Field of the Invention

The present invention is related to an improved bottle opener, and more particularly an improved bottle opener which is multi-functional and efficiently draws a cork from a bottle.

2. Description of Related Art

Bottle openers have been invaluable tools for many years, and enable content-preserving elements such as corks to be removed from containers so that people may enjoy their drinks. However, many of the prior art bottle openers have drawbacks which are as listed below.

A first prior art cork screw (80) is shown in FIG. 12 and includes a handle (81) and a helical coil (83) secured to the handle (81). To extract a cork from a bottle, a distal tip of the coil (83) must first be centered in a top face of the cork, which in itself is not easy. If the centering is not done correctly it may lead to the coil (83) penetrating a side of the cork whereby the cork may disintegrate when pulled by a user. Once centered, the coil (83) must be screwed into the cork until an appropriate depth of penetration is reached whereafter the corkscrew is pulled away from the bottle in the hope that the cork accompanies it. However this accompaniment is frequently not the case for the following reasons:

1. the cork's friction against the turning coil leads to the cork itself overcoming its grip within the bottle neck, and so complete penetration by the corkscrew is not achieved;
2. the first downward force to penetrate the cork is often excessive, as is the upward force to extract the cork whereby a lot of stress is incurred by the cork, which then often disintegrates;
3. excessive force on the corkscrew is transmitted into only the cork, whereby the cork may be pushed unintentionally into the main body of the bottle, resulting in considerable difficulty in pouring all the contents of the bottle therefrom.

The above three drawbacks are not only inconvenient for a user of the corkscrew, they also lead to considerable embarrassment as failure to open a wine bottle may be viewed as social incompetence by some people.

A second prior art corkscrew (90) is shown in FIG. 13 and includes a body (92), a helical coil (94) with a handle (96) at a top thereof, and two levers (98) rotatably receiving the coil (94) and pivotally attached to the body (92). The body (92) has a circular opening sized to abut a top of a neck of a bottle, yet through which a cork can pass. In operation, the opening is mated with the top of the bottle and the levers (98) are raised to an uppermost position. A distal tip of the coil (94) is placed on the center of the cork and then both downward and twisting forces are applied to the handle (96) whereby the cork is penetrated. Once the required depth of penetration is reached, the handles (98) are brought downward whereby distal lips thereof urge against the top of the bottle and so the cork is usually drawn out of the bottle. However, again inappropriate force on the cork may result in pushing it into the bottle, and rotation or disintegration of the cork.

Thus, there is a long and unfulfilled need for a multi-function bottle opener which is easy to use, and prevents rotation and damage to a cork to be removed.

SUMMARY OF THE INVENTION

An objective of the present invention is to provide an improved multi-function bottle opener which is easy to use.

Another objective of the present invention is to provide an improved multi-function bottle opener which involves a unidirectional opening force.

Other objects, advantages and novel features of the invention will become more apparent from the following detailed description when taken in conjunction with the accompanying drawings.

DETAILED DESCRIPTION OF THE PREFERRED EMBODIMENT

Figure 2:
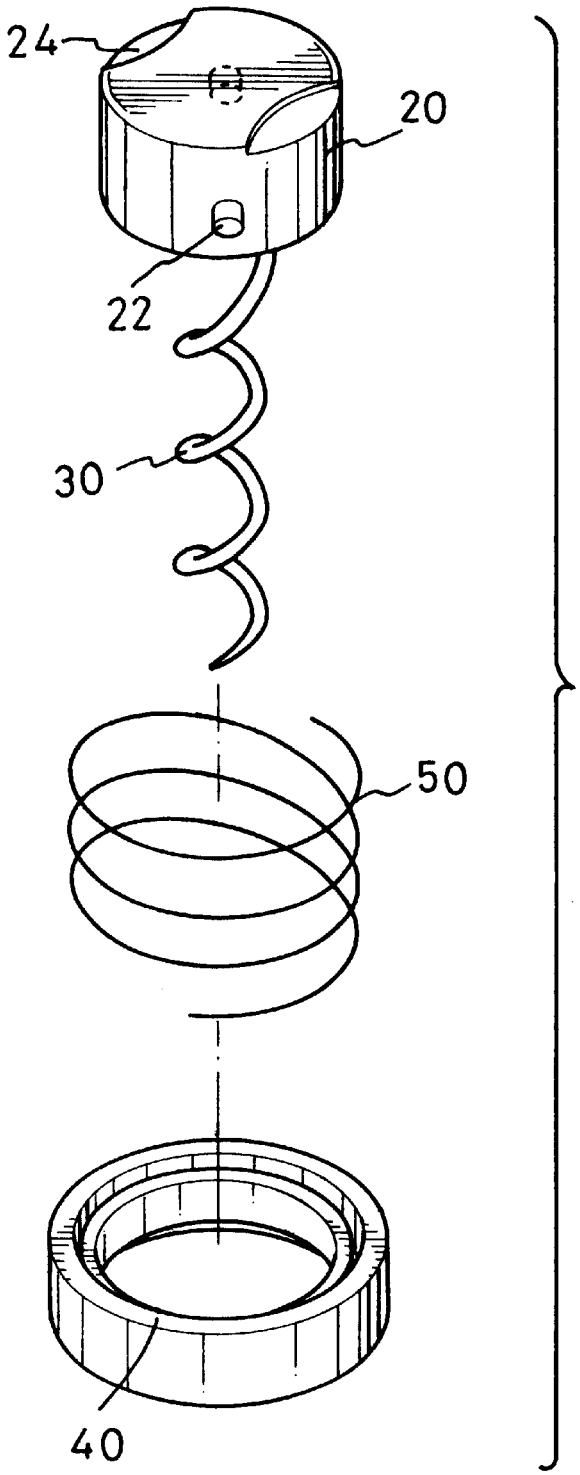
FIG. 2 is an exploded schematic view of part of the bottle opener of FIG. 1.
Figure 3:
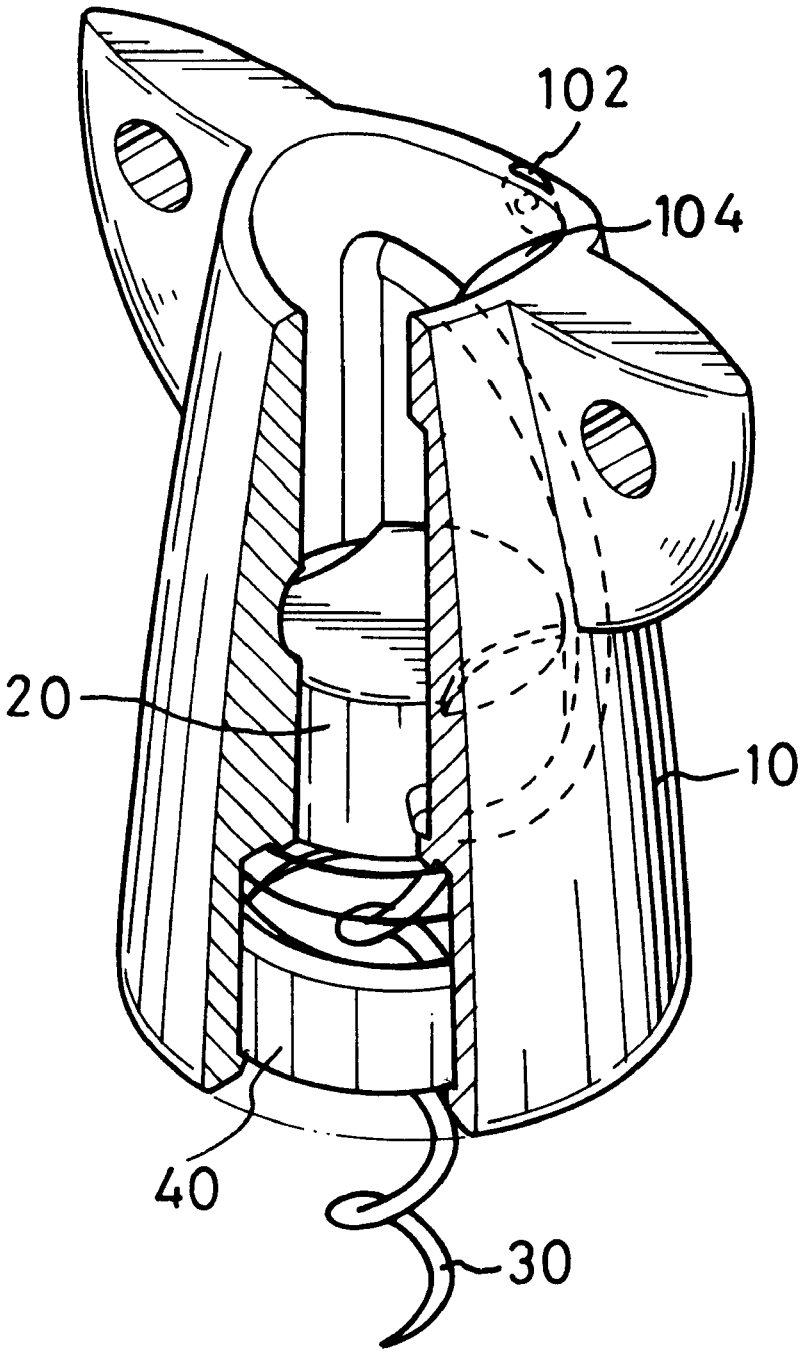
FIG. 3 is a part cross-sectional view of the bottle opener of FIG. 1.
Figure 4:
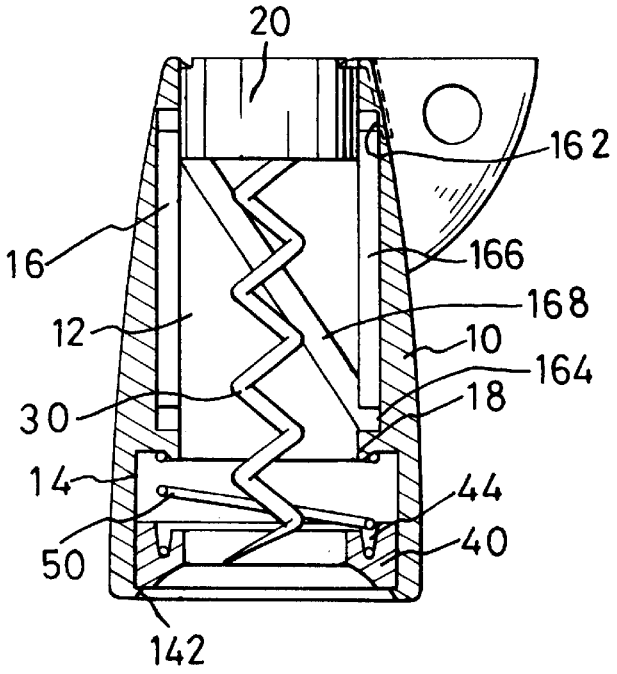
FIG. 4 is a part cross-sectional side view taken along a line 4—4 of FIG. 1, of the bottle opener of FIG. 1 in a first mode.

Referring to the figures and particularly to FIGS. 2, 3 and 4, an improved multi-functional bottle opener comprises a body (10), a piston (20), a helical coil (30), and a collar (40).

Figure 11:
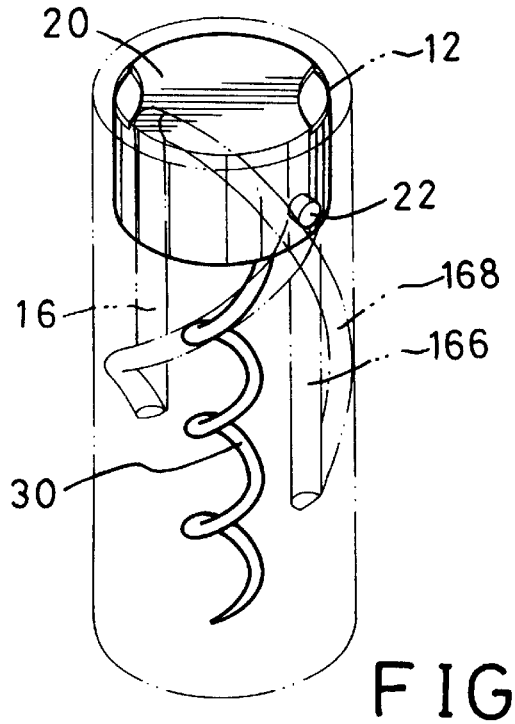
FIG. 11 is a top perspective view of part of the bottle opener of FIG. 1 showing in phantom lines the piston in a second position in the trackway.
Figure 10:
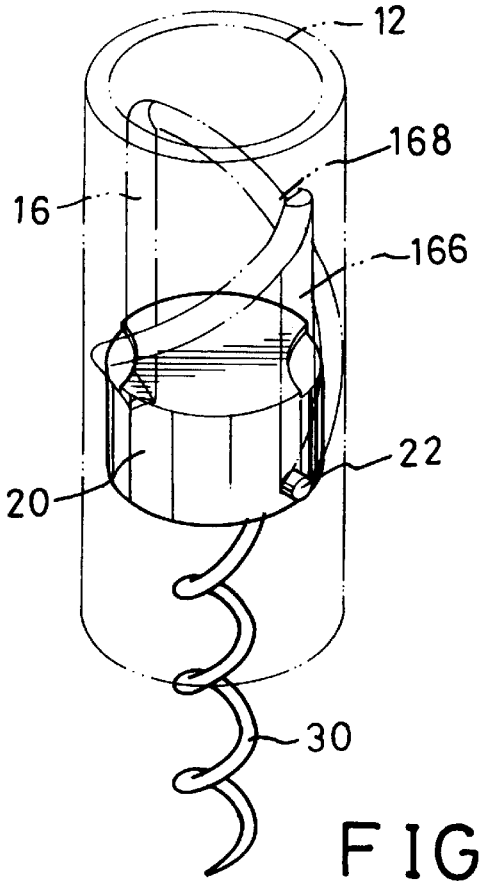
FIG. 10 is a top perspective view of part of the bottle opener of FIG. 1 showing in phantom lines a piston in a first position in a trackway.
Figure 12:
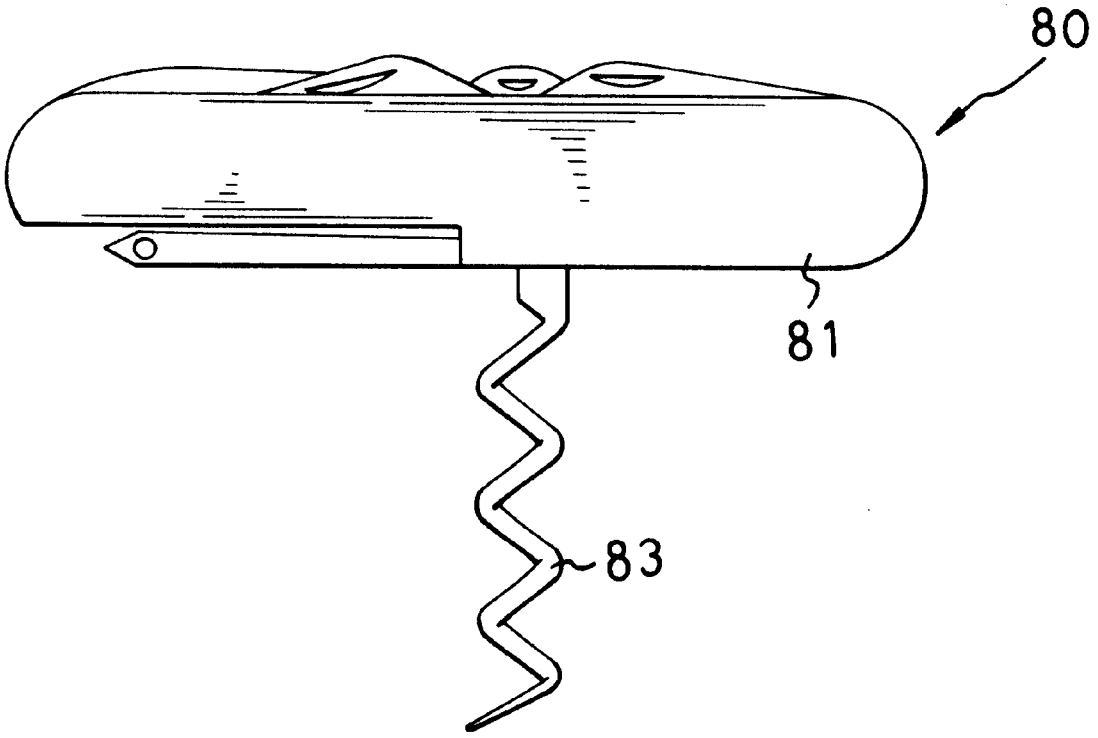
FIG. 12 PRIOR ART
FIG. 12 is a side view of a first prior art bottle opener.
Figure 13:
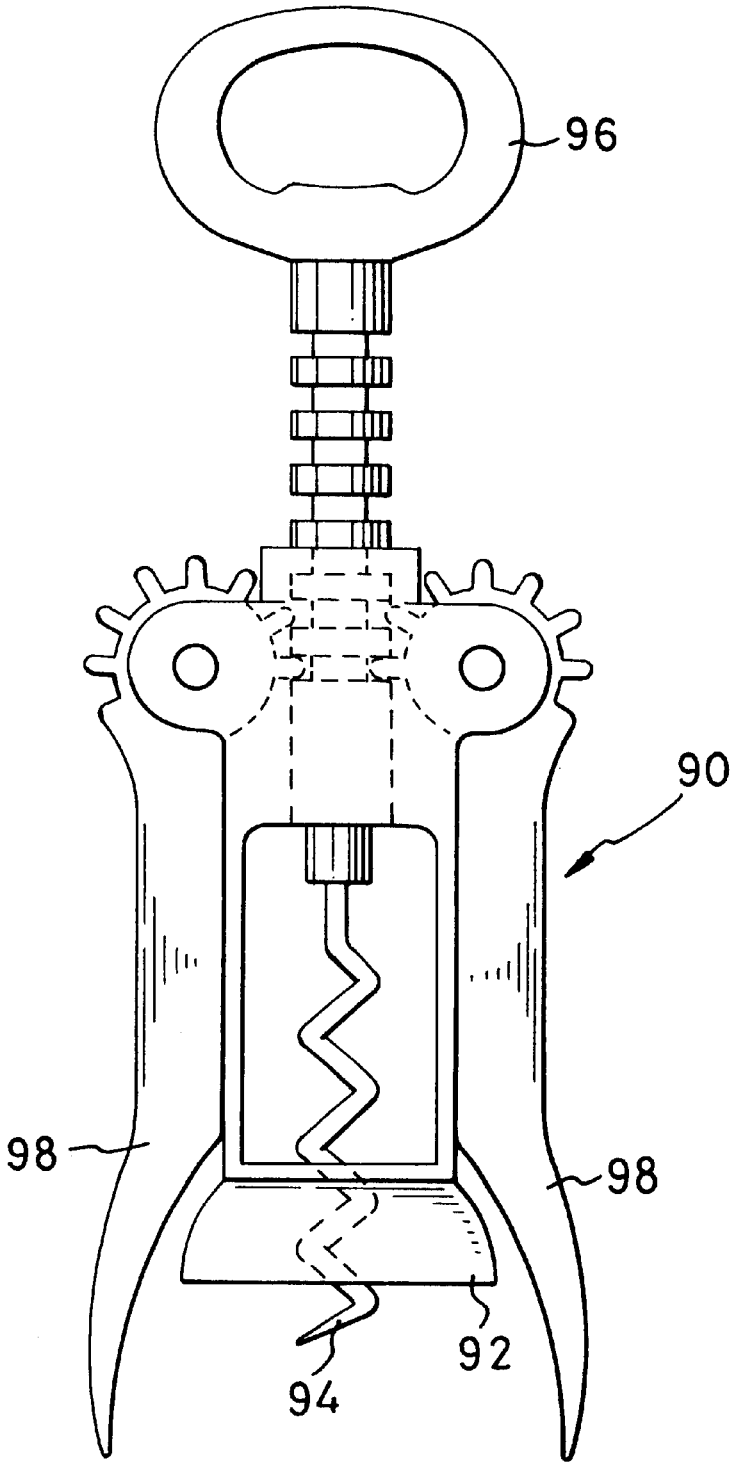
FIG. 13 PRIOR ART
FIG. 13 is a side view of a second prior art bottle opener.

The body (10) includes a top face, a bottom face, a bore (12) extending down from the top face, a counter bore (14) extending up from the bottom face and in communication with the bore (12), a shoulder (18) dividing the bore (12) and counter bore (14), two trackways (16) defined in an inner wall defining the bore (12) and in communication therewith, and two opposed wings integrally extending from a top portion of the body (10). The trackways (16) each have an upper limit (162) and a lower limit (164). An inner flange (142) is formed on a bottom edge of an inner wall defining the counter bore (14). Referring to FIGS. 10 and 11, the trackways (16) are each configured as a loop comprising a longitudinal portion (166) and a helical portion (168).

Still referring to FIGS. 10 and 11, and further to FIG. 4, the piston (20) is sized to be slidingly received in the bore (12) of the body (10), and includes two bottom lugs (22) which are sized to be respectively and engagingly received in the trackways (16). The piston (20) reciprocates between the upper and lower limits (162, 164) of the trackways (16) by first travelling from the upper limits (162) and down the longitudinal portions (166) to arrive at the lower limits (164), and is prevented from rotating in the bore (12) by engagement between the lugs (22) and walls defining the longitudinal portions (166). When the lugs (22) arrive at the lower limits (164) they are allowed to enter and travel up the helical portions (168) to arrive at the upper limits (162) and re-enter the longitudinal portions (166). The helical coil (30) has a first end secured to a bottom of the piston (20) and a second end formed as a distal tip.

Figure 5:
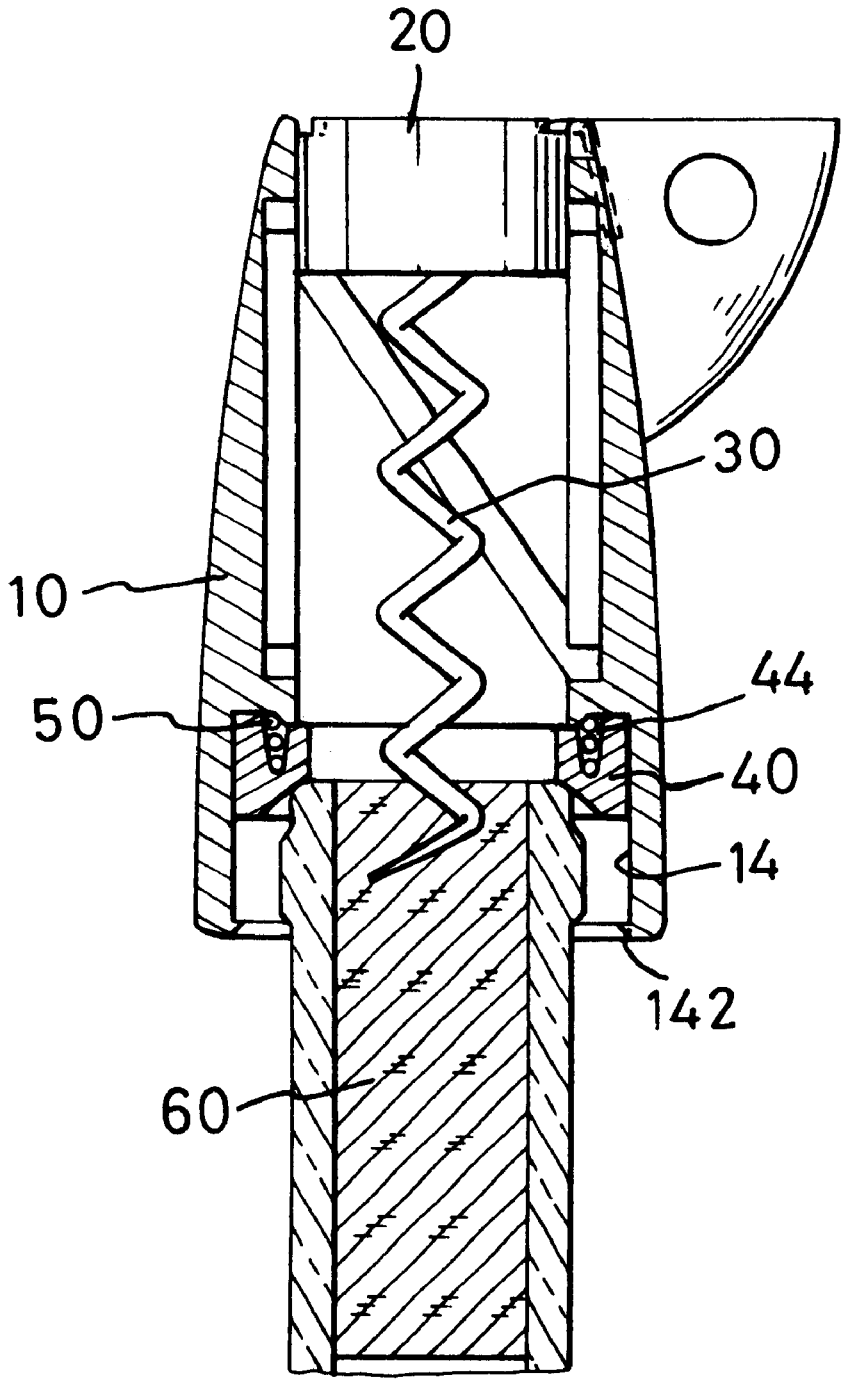
FIG. 5 is a part cross-sectional side view taken along 4—4 of FIG. 1, of the bottle opener of FIG. 1 in a second mode.

Referring to FIGS. 4 and 5, the collar (40) has an outer diameter sized to be slidingly received in the counter bore (14), and reciprocates between an upper end of the counter bore (14) and the inner flange (142). An "O" groove (44) is defined in an upper face of the collar (40). A coil spring (50) has a first end received in the "O" groove (44) and a second end which abuts the shoulder (18) of the body (10). The inner circumference of the collar (40) has a diameter smaller than an outer diameter of a neck of a standard bottle, but larger than an outer diameter of a standard bottle cork (60).

Figure 8:
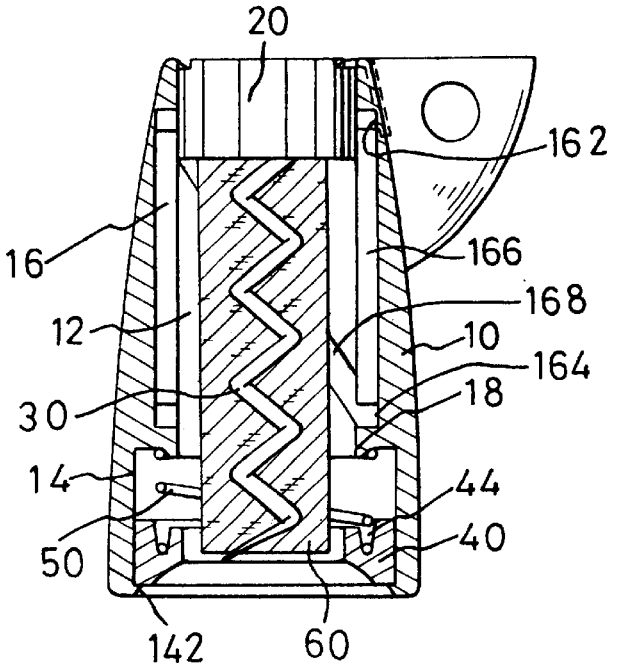
FIG. 8 is a part cross-sectional side view taken along 4—4 of FIG. 1, of the bottle opener of FIG. 1 in a fifth mode.
Figure 6:
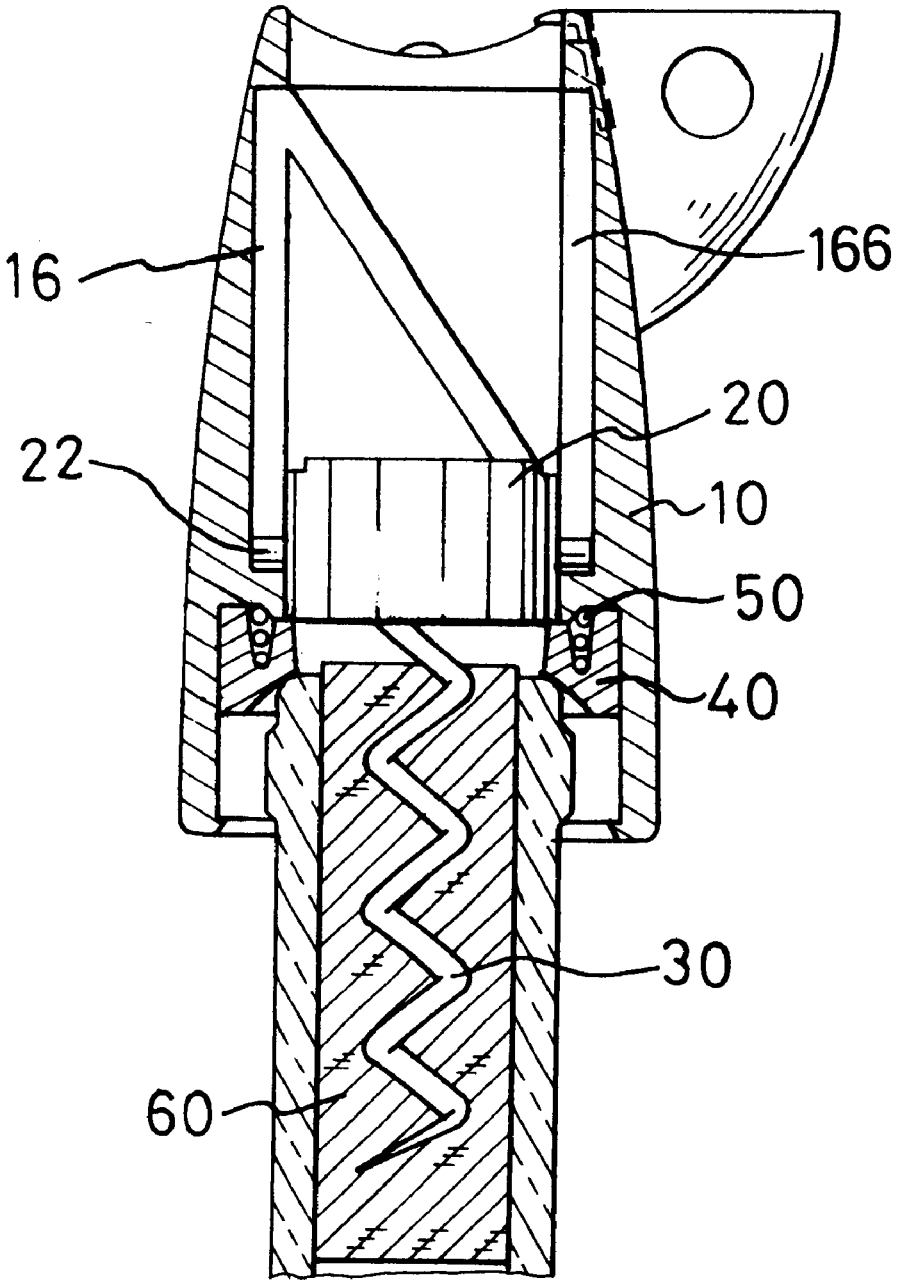
FIG. 6 is a part cross-sectional side view taken along 4—4 of FIG. 1, of the bottle opener of FIG. 1 in a third mode.
Figure 7:
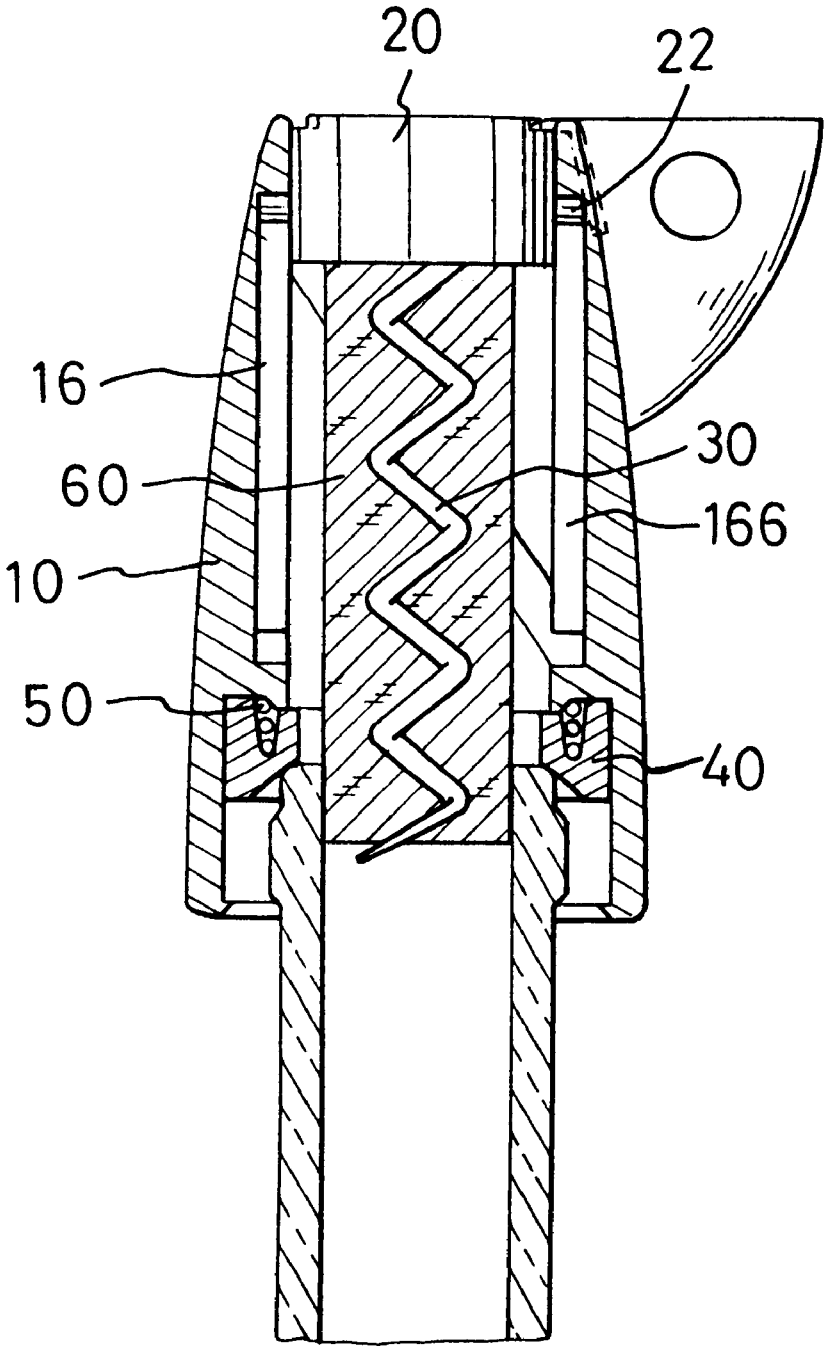
FIG. 7 is a part cross-sectional side view taken along 4—4 of FIG. 1, of the bottle opener of FIG. 1 in a fourth mode.
Figure 9:
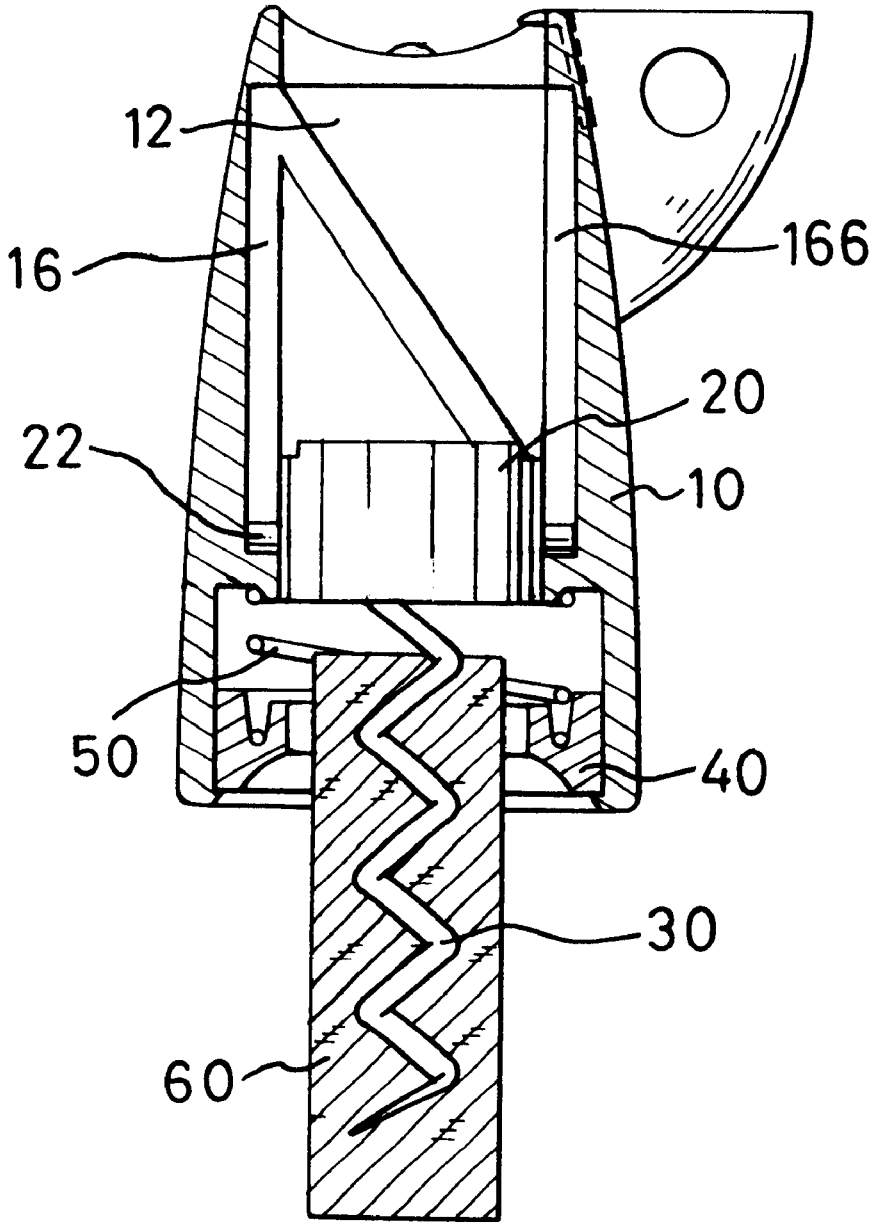
FIG. 9 is a part cross-sectional side view taken along 4—4 of FIG. 1, of the bottle opener of FIG. 1 in a sixth mode.

In operation, referring to FIG. 5, the body (10) is mounted over a bottle such that the counter bore (14) receives therein the bottle's neck. The collar (40) abuts a distal edge of the neck, and the distal tip of the helical coil (30) begins to enter the cork (60) as the body (10) is rotated. Referring to FIG. 6, as the body (10) is further twisted in the same direction, the helical coil (30) is progressively drawn into the cork (60) and the piston (20) accordingly travels down the bore (12) until it reaches the lower limit (164). Referring to FIG. 7, as the body (10) keeps being twisted in the same direction, the lugs (22) exit the longitudinal portion (166) and enter the helical portions (168) to travel up to the upper limits whereby the cork (60) is pulled out of the neck of the bottle. Referring to FIG. 8, the combined bottle opener and cork (60) are taken from the bottle. Referring to FIG. 9, to remove the cork (60) from the bottle opener, the user pushes the piston (20) down the bore (12) whereby the cork (60) protrudes from the inner flange (142) of the counter bore (14) such that the user may unscrew the cork (60) from the helical coil (30).

Figure 1:
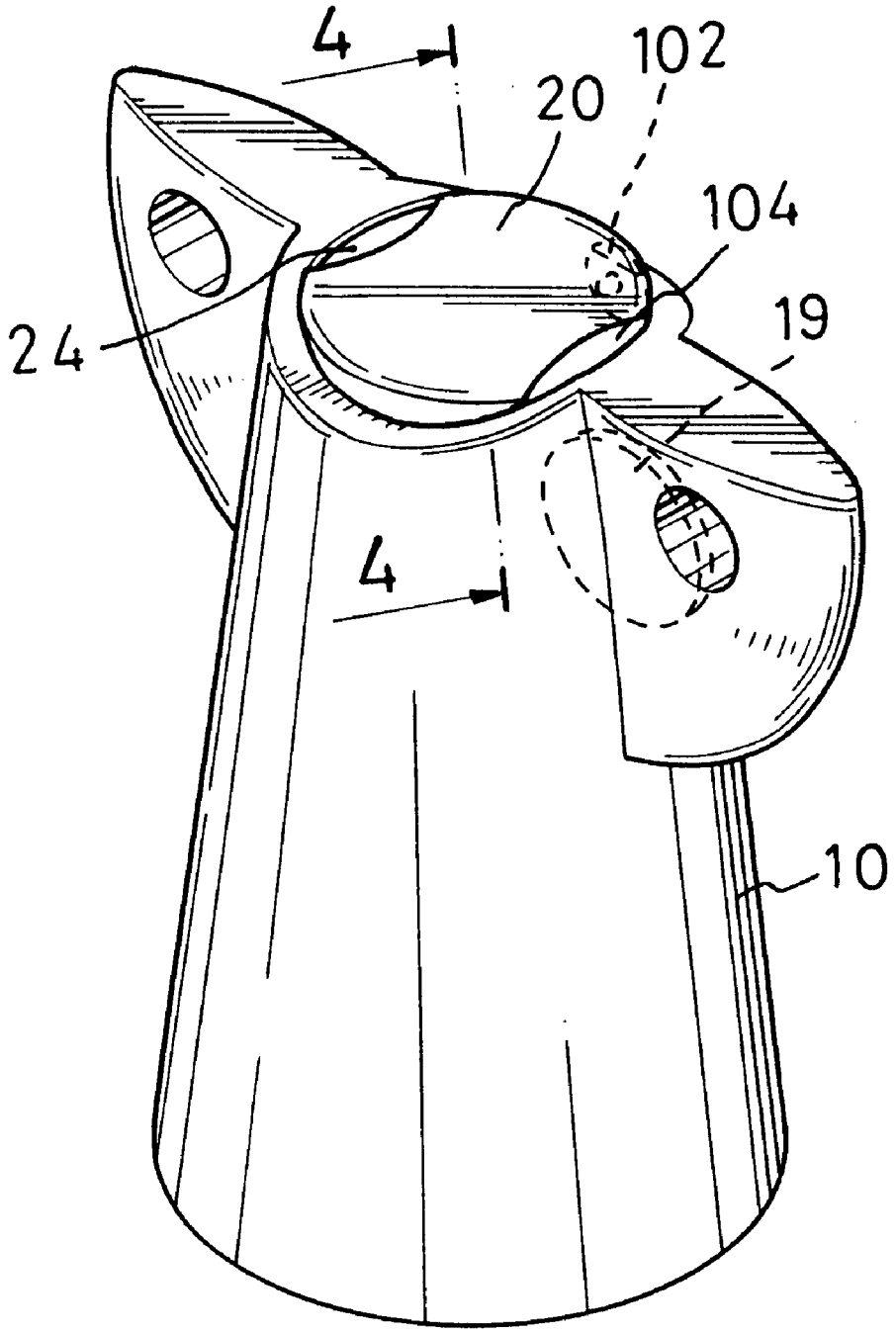
FIG. 1 is a top front perspective view of an improved multi-functional bottle opener in accordance with the present invention.

Referring to FIG. 1, the body (10) can be made of molded plastic and include a magnet (19) embedded therein during the molding process. The magnet (19) allows convenient attachment to a surface such as a door of a refrigerator.

A cutting wheel (102) can be retained in an upper edge of the body (10) whereby foil wrapped around a neck of a bottle can be neatly cut away by urging the cutting wheel (102) around the foil-wrapped neck.

A metal lip (104) can be embedded in the wall defining the bore (12) of the body (10) during the molding process whereby a bottle cap remover is formed.

Still referring to FIG. 1 and further to FIG. 2, a top face of the piston (20) includes two inclined cut outs (24) both sized to snappingly engage with the metal lip (104) when respectively aligning therewith. To enable easy assembly of the piston (20), there are two of the cut outs (24), even though only one of them can function at one time to retain the piston (20) and the helical coil (30) in the body (10) when not needed. The positions of the cut outs (24) do not align with the bottom lugs (22).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An improved multi-function bottle opener comprising:

a hollow body including a bore, a counter bore in communication with the bore, a shoulder formed between the bore and counter bore, a guidance device defining at least one loop in a wall defining the bore, and a retention element formed in the counter bore;

a piston received in the bore and reciprocally movable between upper and lower limits of the bore, and including a follower device traveling along the guidance device;

a collar slidingly received in the counter bore and reciprocating between the shoulder and the retention element;

a corkscrew with a first end secured to the piston and a pointed second end;

a resilient element disposed between the collar and the shoulder; wherein when the collar of the improved bottle opener is mated with a neck of a bottle to remove a cork therefrom, the hollow body is continuously rotated in one direction such that the piston is linearly guided by the guidance device down the bore as the corkscrew penetrates the cork, and then is rotationally guided by the guidance device up the bore, whereby the cork is removed from the neck of the bottle while the body is still mated with the bottle.

2. The improved multi-function bottle opener as claimed in claim 1, wherein the guidance device comprises two opposed trackways defined in a wall defining the bore, each trackway comprising a longitudinal portion with a first end and a second end, and a helical portion with a first end communicating with the second end of the longitudinal portion, and a second end in communication with the first end of the longitudinal portion.

3. The improved multi-function bottle opener as claimed in claim 1, wherein the follower device comprises two opposed lugs sized to be slidingly received in the guidance device.

4. The improved multi-function bottle opener as claimed in claim 1, wherein the retention element is an inner flange with an inner diameter smaller than an outer diameter of the collar.

5. The improved multi-function bottle opener as claimed in claim 1, further including a lip formed in the bore and functioning as a bottle cap remover.

6. The improved multi-function bottle opener as claimed in claim 1, wherein the body includes a magnet for attachment of the bottle opener to a ferrous surface.

7. The improved multi-function bottle opener as claimed in claim 1, wherein a cutting wheel is housed in the body, whereby a foil of a bottle can be cut.

8. The improved multi-function bottle opener as claimed in claim 5, wherein at least one inclined cut out is defined in a top face of the piston, whereby the lip is snappingly engageable with the inclined cut out when the piston is in an uppermost position in the body.

9. An improved multi-function bottle opener comprising:

a hollow body comprising a bore, a counter bore, a shoulder formed between the bore and the counter bore and two opposed ears;

a piston received in the bore and reciprocating between an upper limit of the bore and a lower limit of the bore, a downward travel of the piston from the upper limit to the lower limit being non-rotational with respect to the body, and an upward travel of the piston from the lower limit to the upper limit being rotational with respect to the body;

a collar slidably received between upper and lower limits of the counter bore;

a corkscrew with a first end secured to a bottom face of the piston and a pointed second end;

a spring received in the counter bore, and having a first end abutting the shoulder of the body, and a second end abutting an upper face of the collar, wherein when the collar of the improved bottle opener is mated with a neck of a bottle to remove a cork therefrom, the hollow body is continuously rotated in one direction, whereby the cork is removed from the neck of the bottle while the hollow body is still mated with the bottle.

* * * * *

UNITED STATES PATENT AND TRADEMARK OFFICE

CERTIFICATE OF CORRECTION

PATENT NO. : 6,282,985 B1
DATED : September 4, 2001
INVENTOR(S) : Justin Wen-Tien Tseng It is certified that error appears in the above-identified patent and that said Letters Patent is hereby corrected as shown below:

Title page,
Insert -- [73] Assignee: Costek International Ltd.,
Kln., Hong Kong (HK) --

Signed and Sealed this

Fifth Day of November, 2002

*Attest:*

*Attesting Officer*

JAMES E. ROGAN
*Director of the United States Patent and Trademark Office*